US006003166A

United States Patent [19]

Hald et al.

[11] Patent Number: 6,003,166

[45] Date of Patent: Dec. 21, 1999

[54] PORTABLE SPA

[75] Inventors: Patrick J. Hald, Los Osos, Calif.; Scott R. Watterson; William T. Dalebout, both of Logan, Utah; Timothy O. Armstrong, Providence, Utah; Michael Dolder, Powell, Ohio

[73] Assignee: Icon Health and Fitness, Inc., Logan, Utah

[21] Appl. No.: 08/996,616

[22] Filed: Dec. 23, 1997

[51] Int. Cl.[6] ..... A61H 33/00

[52] U.S. Cl. ..... 4/541.1; 4/492; 4/493; 417/32; 137/563; 137/565

[58] Field of Search ..... 4/541.1–541.6, 4/492, 493, 509; 137/563, 565; 417/32, 361

[56] References Cited

U.S. PATENT DOCUMENTS

| | | | |
|---|---|---|---|
| 3,273,560 | 9/1966 | Jacuzzi | 128/66 |
| 3,286,712 | 11/1966 | Roden | 128/66 |
| 3,534,730 | 10/1970 | Jacuzzi | 128/66 |
| 3,861,384 | 1/1975 | Casternovia | 128/66 |
| 3,911,505 | 10/1975 | Zaborowsky | 4/178 |
| 3,961,382 | 6/1976 | Peterson, Jr. | 4/178 |
| 4,100,917 | 7/1978 | Talge et al. | 128/66 |
| 4,127,117 | 11/1978 | Peterson, Jr. | 128/66 |
| 4,225,984 | 10/1980 | Lindsey | 4/541 |
| 4,402,094 | 9/1983 | Sanders | 4/504 |
| 4,630,599 | 12/1986 | Perovick et al. | 128/66 |
| 4,665,572 | 5/1987 | Davidson et al. | 4/492 |
| 4,774,934 | 10/1988 | Hara | 128/66 |
| 4,942,871 | 7/1990 | Hara | 128/66 |
| 4,957,101 | 9/1990 | Hara | 128/66 |
| 5,031,255 | 7/1991 | Hilger et al. | 4/542 |
| 5,283,915 | 2/1994 | Idland et al. | 4/541.1 |
| 5,335,376 | 8/1994 | Kaldewei | 4/541.6 |
| 5,386,598 | 2/1995 | Mersmann | 4/541.4 |
| 5,404,598 | 4/1995 | Hadsell | 4/541.4 |
| 5,408,707 | 4/1995 | Wilson | 4/541.1 |
| 5,526,538 | 6/1996 | Rainwater | 4/541.1 |

OTHER PUBLICATIONS

Spa to Go Installation (VHS Video Cassette Tape), Ohio Steel Industries. On information and belief, the Spa to Go Installation video was publicly available in Jul. 1996.

*Primary Examiner*—Charles R. Eloshway
*Attorney, Agent, or Firm*—Workman, Nydegger & Seeley; Jonathan W. Richards; David B. Dellenbach

[57] ABSTRACT

A spa has (a) a bath having an upstanding wall; and (b) a pump assembly removably mounted to the wall of the bath. The pump assembly comprises (i) a U-shaped cover having a dry leg, a wet leg, and a mounting groove formed therebetween, the wet leg of the cover having an inlet port and an outlet port extending therethrough; (ii) a pump disposed within the dry leg of the cover; (iii) an inlet conduit extending from the inlet port to the pump; and (iv) an outlet conduit extending from the outlet port to the pump.

36 Claims, 9 Drawing Sheets

PORTABLE SPA

BACKGROUND OF THE INVENTION

1. The Field of the Invention

This invention is in the field of therapy units associated with liquid-filled containers. More specifically, this invention relates to portable spas.

2. The Relevant Technology

In ancient times, hydrotherapy was enjoyed by those who were privileged enough to have access to a heated pool or natural mineral spa. Since then, hydrotherapy has been known for its many therapeutic benefits and for the enjoyment and pleasure derived therefrom.

In more recent times, spas, commonly known as hot tubs, have become popular devices in gymnasium facilities, adjacent indoor and outdoor pools, and as freestanding fixtures in individual homes and yards. Such spas are typically comprised of a water-filled container, a pump for circulating water within the container, a heating system for heating the water, a filter for filtering the water and related plumbing and electronics.

In typical spas, these components are permanently built into the walls of the container. Water within the spa container flows out of the container through ports in the wall of the container into a pump unit, which then discharges the water back into the container. A temperature regulator regulates the temperature of the water within the spa and maintains the temperature at a desired, preset level over a series of days, weeks, and months at a time. The filter is designed to clean the water on an ongoing basis.

However, such spas having permanently built-in plumbing and pumping systems tend to be large, expensive, and difficult to transport. In order to move such a unit, a truck or trailer is typically required along with significant manpower in order to hoist the spa from the original position onto the means of transport and then to again lift the spa from the means of transport to a new location. Upon arriving at the new location, such self-contained units are also difficult to orient in the precisely desired position.

As a result of the cumbersome nature of these spas, attempts have been made to design and manufacture portable spas. Portable spas typically include a portable container and a detachable pump unit positioned outside the container. In order to provide the jetting action of the water disposed within the container, the container has a hole within a wall thereof through which inlet and outlet pipes are placed. These through-the-wall plumbing designs permit the pumping of water between the inside portion of the container and the pump unit. After use, the pumping unit is detached from the container and the container and pumping unit are transported to another desired location.

The difficulty associated with such through-the-wall plumbing designs is that water tends to leak through the holes in the wall of the container. Although attempts can be made to seal the interface between the pipes and the container, such as by attempting to permanently couple pipes through a hole in a liner which is removably coupled to a container, it is difficult to maintain the seal between the pipes and the liner on an ongoing basis. The difficulty with maintaining the seal is compounded when the spa is moved from one location to another with the accompanying jostling of the interface between the pipes and the liner. Although sealing rings have been used to seal these types of through-the-wall units, the sealing interface can nevertheless breakdown and degrade.

As another alternative for those desiring to enjoy the benefits of hydrotherapy without investing in a spa having permanently built in plumbing or a portable spa having a through-the-wall pumping unit, it is possible to purchase a U-shaped whirlpool apparatus which fits over the side of a bathtub. Generally, such whirlpool apparatuses are configured to jet water in the bathtub through ports in the apparatus.

The water in the bathtub is typically clean, warm water. Because they are not designed for long-term use as in the case of spas, typical U-shaped bathtub whirlpool apparatuses do not include a filter for filtering the water in the bathtub. As opposed to spas, bathtub water is typically designed for temporary use, after which the water is discharged through the drain. Similarly, the temperature of the water in bathtubs is controlled by adding additional hot water or cold water from the bathtub taps while bathing. As a result, typical U-shaped bathtub whirlpool devices are not designed to heat the water within the bathtub. Instead, these bathtub whirlpool devices rely on a fresh amount of water which has been warmed to a desired temperature through the use of manual controls on the bathtub.

Also because of their reliance on hot water from the bathtub plumbing, typical U-shaped bathtub-type jetting devices fail to monitor the temperature of the liquid within the bathtub. In the event the device were to be used in an outdoor setting, for example, and the user were to fail to place hot water in the bathtub, the water within the tub could freeze and thereby damage the plumbing within the tub.

Typical over-the-side units employ a pumping mechanism comprising an impeller submerged within the water within a container. In these devices, water flows from the container into the pumping mechanism and remains within the submerged pumping mechanism until it is dispelled back into the container. Manufacturers of typical units take overt measures to prevent water within the pumping mechanism from seeping into portions of the unit higher than the pumping mechanism, such as by sealing the interface between the pumping mechanism and the remainder of the unit. This prevents the water from being pumped to locations other than the submerged pumping mechanism before being discharged back into the container.

In addition, typical U-shaped bathtub pumping mechanisms tend to focus their jetting action exclusively on one portion of the user's body. Certain bathtub-type devices attempt to ameliorate the problem with such exclusive, focused jetting action by employing a variety of different ports located in scattered positions throughout the bathtub. U.S. Pat. No. 5,404,598 to Hadsell, for example, discloses a bathtub hydrotherapy add-on apparatus which includes a pump placed on the outside of the bath tub and a plurality of flexible hoses placed in a number of different sites of the bathtub.

Although the apparatus can be used to jet water from different locations within the bathtub, the hoses must be individually positioned by a user for each new use. Furthermore, each hose must be removed individually after each use. In addition, each of the hoses must be gathered together in order to move and store the apparatus without dragging the hoses on the floor or leaving the hoses in a disorganized pile.

There is therefore a need within the art for a portable spa system which heats and circulates liquid within the system without relying on the user to constantly replace cool, dirty water with fresh, warm water. There is also a need for such a portable spa system which is not susceptible to leaking of the water through the wall of a container and does not require the user to place disorganized hoses in different locations in the container.

SUMMARY AND OBJECTS OF THE INVENTION

It is therefore an object of the invention to provide an improved portable spa

It is another object of the invention to provide a portable spa which heats and circulates liquid within the system without relying on the user to constantly replace cool, dirty water with fresh, warm water.

It is another object of the invention to provide a portable spa system which is not susceptible to leaking of the water through the wall of a container.

It is another object of the invention to provide a portable spa pump assembly.

It is a further object of the invention to provide such a portable spa pump assembly which includes a pump disposed along with associated plumbing within an organized cover.

It is a further object of the invention to provide a spa pump assembly having a filter for filtering water on an ongoing basis within the spa.

It is a further object of the invention to provide a spa pump assembly which regulates the temperature of the liquid within the spa and heats the liquid.

The spa of the present invention comprises (a) a bath having an upstanding wall; and (b) a pump assembly removably mounted to the wall of the bath. One embodiment of the pump assembly comprises (i) a U-shaped cover having a dry leg, a wet leg, and a mounting groove formed therebetween, the wet leg of the cover having an inlet port and an outlet port extending therethrough; (ii) a pump disposed within the dry leg of the cover; (iii) an inlet conduit extending from the inlet port to the pump; and (iv) an outlet conduit extending from the outlet port to the pump.

The groove is configured to receive the wall of the bath such that the wet leg is received within the bath. The pump, the outlet conduit, and the inlet conduit are thus substantially located between the U-shaped cover and the wall. The wet leg and the wall of the spa bath form an internal cove for liquid to be disposed between the wet leg and the wall. A temperature sensor is disposed within the liquid in the internal cove between the wall and the wet leg.

The pump is configured to heat liquid within the spa. The sensor is electrically coupled to the pump and senses the temperature of liquid within the spa bath. The pump is activated when the temperature of the liquid drops below a desired, selected temperature. The wet leg allows water to flow into the cavity while nevertheless protecting the sensor from the activities occurring within the spa bath. A filter is also coupled to the inlet conduit to clean water entering the spa pump assembly. A heating element may also be employed to heat liquid within the spa.

The spa pump assembly is capable of maintaining clean water at a desired temperature for long periods of time yet is readily portable to a remote location. The spa pump assembly heats and circulates liquid within the spa without relying on the user to constantly replace cool, dirty water with fresh, warm water. Since the spa pump assembly fits over a wall of the spa bath rather than having plumbing disposed through the wall, the spa pump assembly avoids the problems associated with water leaking through the wall.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
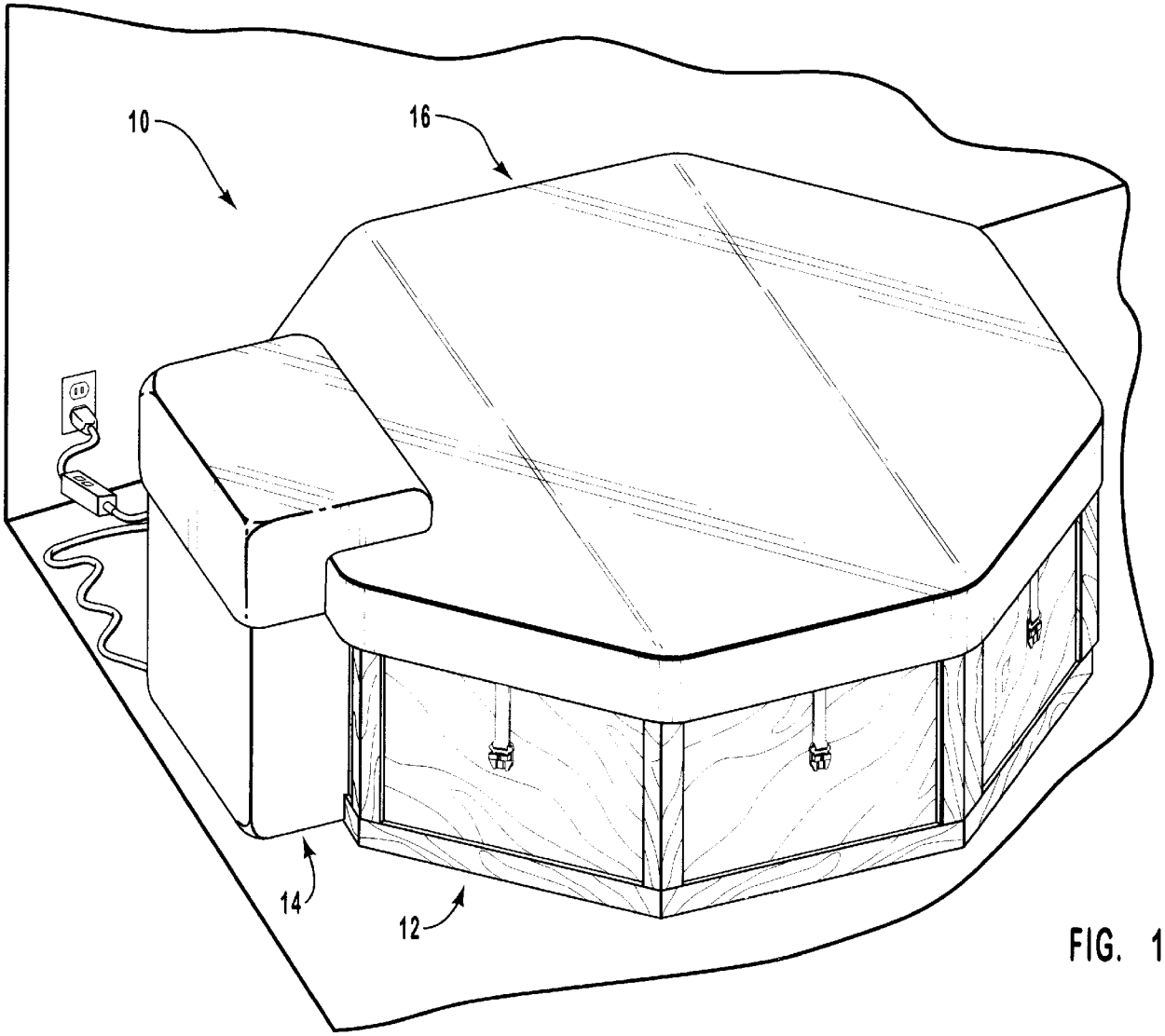
FIG. 1 demonstrates a perspective view of a portable spa of the present invention.

With reference now to FIG. 1, portable spa 10 will be described in detail. Spa 10 comprises a spa bath 12, a spa pump assembly 14 configured to be removably mounted to spa bath 12 and a lid 16 covering both spa bath 12 and assembly 14.

Figure 2:
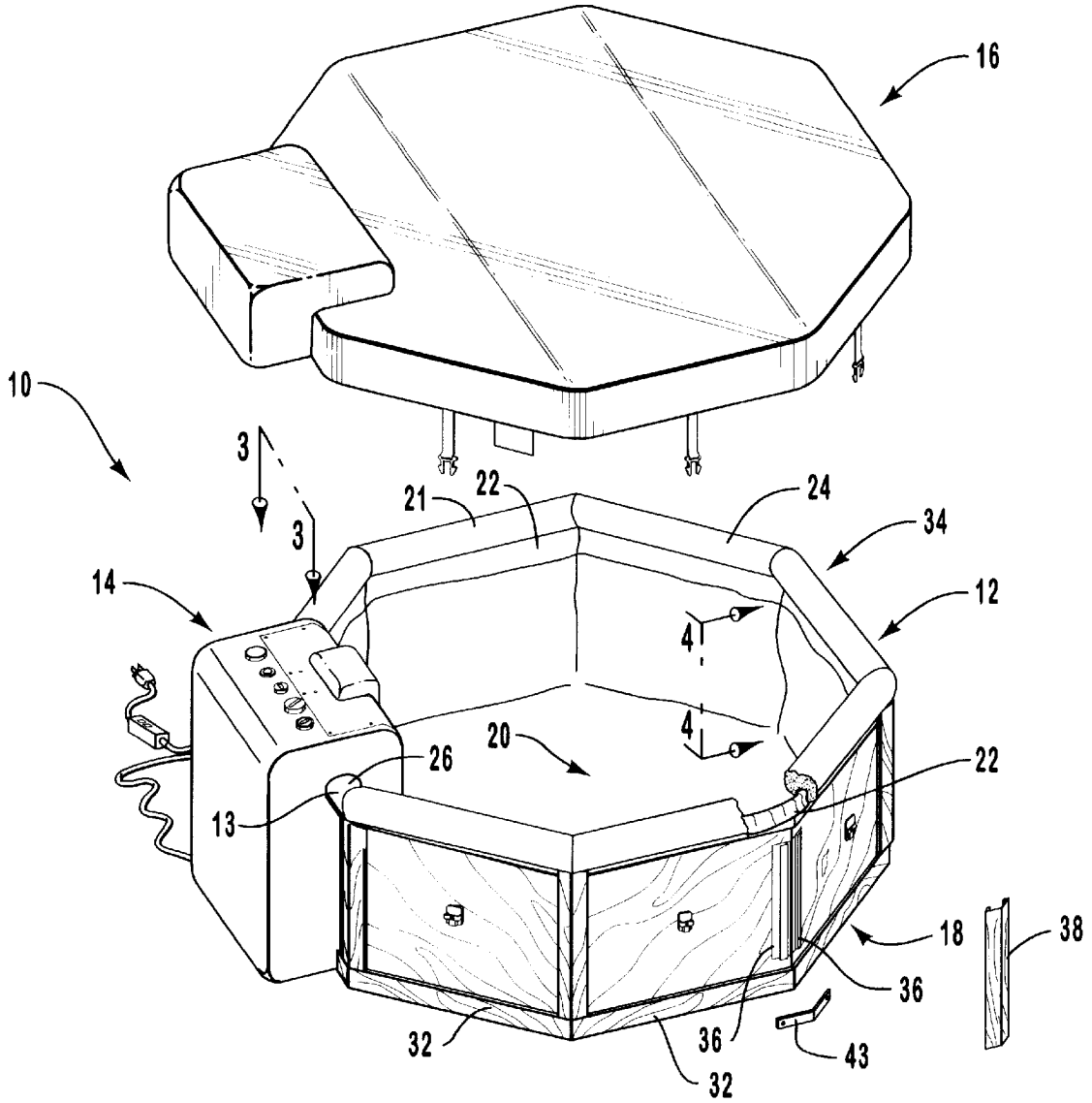
FIG. 2 demonstrates a partially exploded view of the portable spa shown in FIG. 1. A portion of the spa bath is cut away.

FIG. 2 demonstrates lid 16 exploded from spa bath 12 and assembly 14. As further shown in FIG. 2, assembly 14 is removably coupled on opposing sides of a perimeter wall 34 of spa bath 12 atop rim 21 of wall 34. Assembly 14 siphons water from within spa bath 12, filters the water, directs the water over wall 34 where the water is heated within assembly 14 and then directs the water back into spa bath 12. Assembly 14 is an organized, portable self-contained unit which is readily transported and stored.

Spa bath 12 is shown in FIG. 2 on a support surface. In the embodiment shown in FIG. 2, spa bath 12 comprises (i) an outer container body 18; (ii) an inner liner 20 disposed against the inner surface of container body 18 and over the rim of container body 18; and (iii) eight foam clamps 24, 26 having an outer bulbous shape and an inner U-shape disposed over the interface between rim 22 of liner 20 and the rim of container body 18 to removably affix rim 22 of liner to body 18 and provide a cushioned rim 21 of wall 34. Clamp 26 below container 14 is slightly smaller than the other seven clamps 24 to allow assembly 14 to be conveniently placed on spa bath 12 while providing large cushioned clamps 24.

Figure 3:
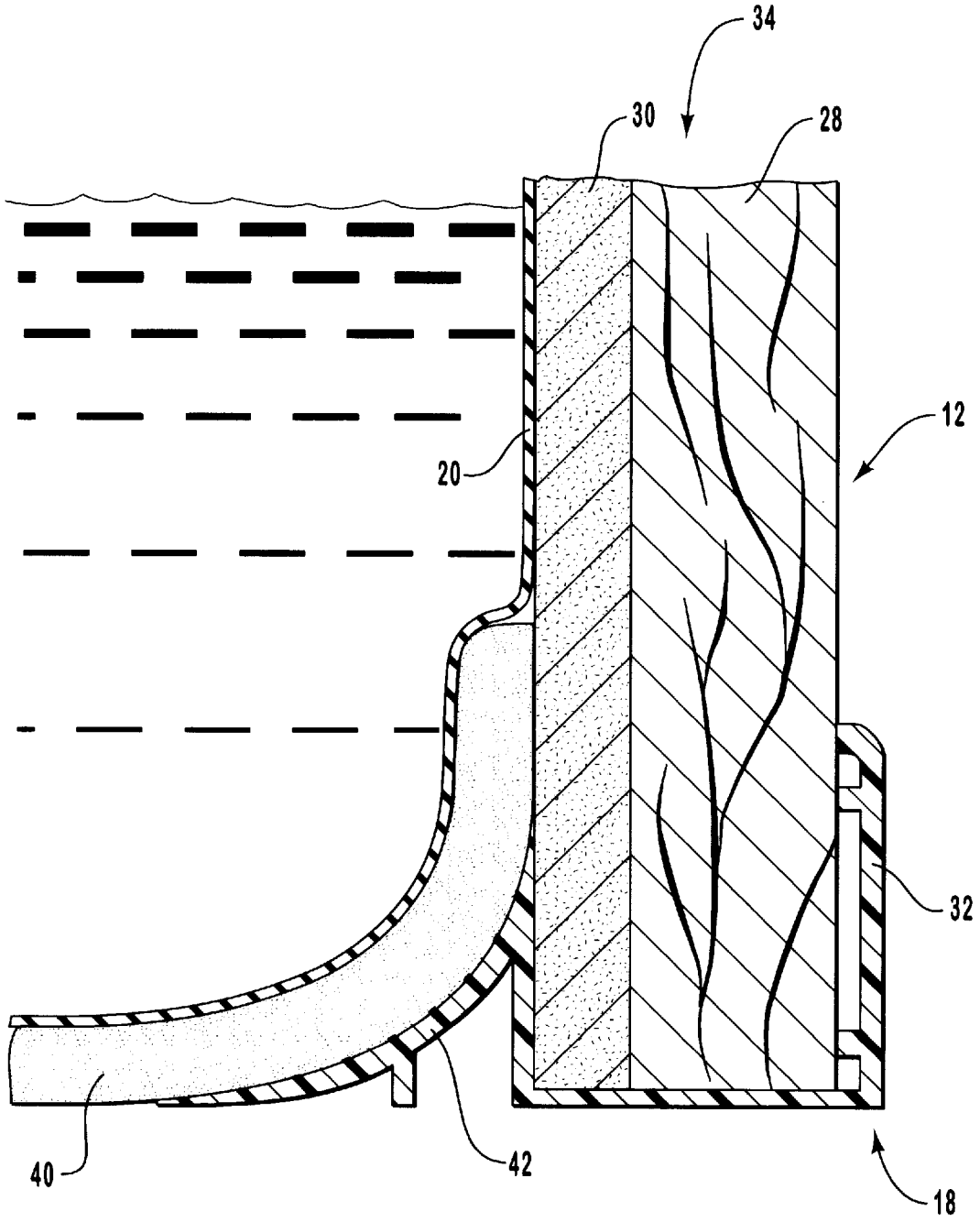
FIG. 3 demonstrates a partial cross-sectional view of the container shown in FIG. 2.

With reference now to FIGS. 2 and 3, container body 18 may be comprised of a variety of different elements. In the embodiment shown, container body 18 comprises eight different sections. Each section is comprised of a wooden panel 28, a corresponding foam panel 30 and a floor bracket 32 coupling wood and foam panels 28, 30 together.

In order to couple one section to the seven other adjacent sections to form an octagonal container body 18, each wood panel 28 includes on opposing sides thereof side brackets 36, each of which have a lip which receives an end of a respective connecting bracket 38. In addition, in order to couple panels 28 to each other, an angled plate 43 is coupled to adjacent panels 28 and is disposed between panels 28 and floor brackets 32. Screws are disposed through floor brackets 32 and through opposing sides of plate 43 into T-nuts coupled to panels 28. After the sections of container body 18 are connected, forming a perimeter wall 34, a floor 40 is disposed within the wall 34 on curved portions 42 of floor brackets 32.

Although the configuration of spa bath 12 has been described in detail, it will be appreciated that spa bath 12 may comprise a variety of different containers. Containers employed in the present invention may include a liner or may be operated without the use of a liner. Examples of containers which serve as examples of spa bath 12 include a container made of acrylic, metal, steel, plywood, porcelain, fiberglass or an inflatable container having a band or girdle wrapped thereabout for supporting the inflatable container, and a variety of other containers presently known within the art.

Preferably, the liquid within spa bath 12 comprises water which has been properly chemically treated before use and is tested and treated on an ongoing basis. Movable seats or sectional pieces may be placed into spa bath 12.

Assembly 14 will now be described in additional detail with reference to FIG. 4. Assembly 14 comprises a pump 44, inlet plumbing 45, and outlet plumbing 47. Pump 44 and plumbing 45, 47 are depicted in a schematic view in FIG. 9, which will be discussed in additional detail below. As used throughout this specification and the appended claims, the word "plumbing" refers to at least one conduit, such as a pipe or a series of connected pipes, connectors and fittings.

Figure 4:
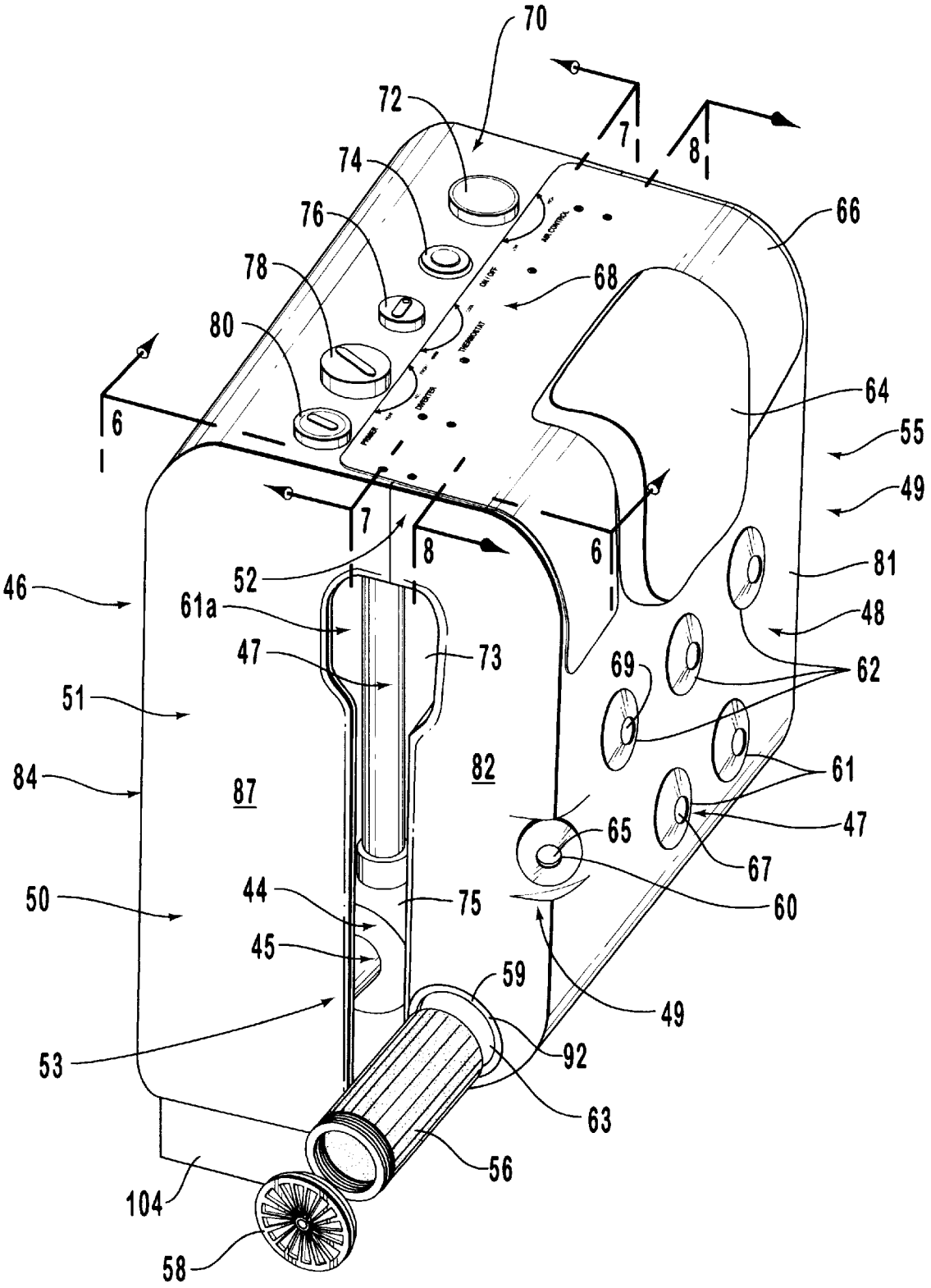
FIG. 4 demonstrates a perspective view of the portable spa pump assembly of the present invention.

With continued reference to FIG. 4, assembly 14 further comprises means for removably securing pump 44, inlet plumbing 45, and outlet plumbing 47 to wall 34 of spa bath 12 as a self-contained assembly. As one example of such a means for removably securing these components to spa bath 12 as a self-contained assembly, assembly 14 comprises U-shaped cover 46 at least partially surrounding and coupled to pump 44, inlet plumbing 45, and outlet plumbing 47.

As used throughout this specification and the appended claims, in one embodiment, the phrase "self-contained assembly" or a substantially similar phrase refers to an assembly such as assembly 14 which is built as a compact, organized, cohesive single unit having pump 44 and inlet and outlet plumbing 45, 47 at least partially surrounded by cover 46. In a preferred embodiment, the phrase "self-contained assembly" or a substantially similar phrase includes an assembly such as assembly 14 which has ports for plumbing 45, 47 extending through cover 46, control knobs on cover 46, and/or an electrical cord which extends through cover 46 to an electrical outlet.

In another preferred embodiment, the phrase "self-contained assembly" or a substantially similar phrase refers to an assembly such as assembly 14 in which approximately half or more of the surface area of pump 44 and inlet and outlet plumbing 45, 47 are surrounded by cover 46. In another preferred embodiment, the phrase "self-contained assembly" or a substantially similar phrase refers to an assembly such as assembly 14 in which approximately three fourths or more of the surface area of pump 44 and inlet and outlet plumbing 45, 47 are surrounded by cover 46.

As one example of a self-contained assembly, while it may be possible to see part of pump 44 and portions of plumbing 45, 47 upon looking carefully into the interior of cover 46 in FIG. 4, none of these components or other components of assembly 14 protrude significantly away from the interior of cover 46 other than a portion of an electrical cord, which is generally not a cumbersome element and is common and convenient for users to orient.

Figure 5:
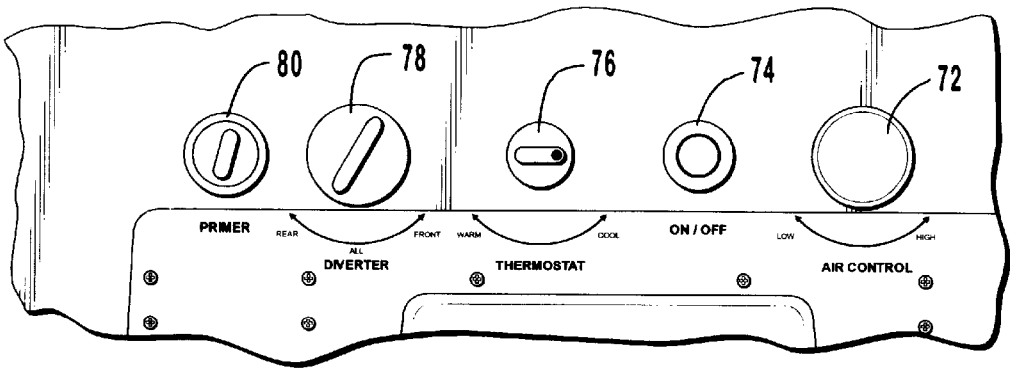
FIG. 5 demonstrates a cutaway view of the electronics panel of the spa pump assembly shown in FIG. 4.

In another preferred embodiment, as shown in FIGS. 2 and 5, the phrase "self-contained assembly" or a substantially similar phrase refers to an assembly such as assembly 14 wherein, upon placing the assembly 14 onto wall 34 of spa bath 12, pump 44, outlet plumbing 45, and inlet plumbing 47 are substantially surrounded by the opposing sides of wall 34 of spa bath 12 and cover 46.

With continued reference to FIG. 4, cover 46 comprises (i) a first cover portion such as shell 48; and (ii) means attached to the first cover portion 48 for removably securing pump 44 and first cover portion 48 to wall 34 of spa bath 12. In the embodiment shown in FIG. 4, the means for removably securing pump 44 and first cover portion 48 to wall 34 comprises (i) a second cover portion, such as shell 50, coupled to pump 44, and (ii) means for coupling first shell 48 to second shell 50.

By way of example, in one embodiment, each shell 48, 50 is comprised of a plastic material which is lightweight, and flexible enough to allow assembly 14 to be placed on wall 34, yet sturdy enough to substantially house and protect the internal components of assembly 14. Shells 48, 50 each have a concave configuration. Shell 48 has a face 81 and two side members 82, 83 extending from face 81. Shell 50 includes a face 84, side members 87, 89 extending from opposing sides of face 84, and a resting bracket 104, preferably metal, coupled to face 84 and member 87, 89. The concave configurations of shells 48, 50 combine to house and maintain the internal components of assembly 14 such that assembly 14 is conveniently portable.

In the embodiment shown in FIG. 4, a lower portion of first shell 48 which is disposed within the liquid within spa bath 12 is an example of a wet leg 49 of cover 46 and a lower portion of shell 50 is an example of a dry leg 51 of cover 46. The coupled upper portions of first and second shells 48, 50 are collectively an example of an intermediate portion 52 of the cover 46 coupling wet leg 49 to dry leg 51. In another embodiment, intermediate portion 52 is a single integral piece.

A mounting groove 61A of cover 46 is formed between wet leg 49 and dry leg 51. In the embodiment shown in FIG. 4, groove 61A has an upper bulbous portion 73 and a lower, rectangular portion 75. It will be appreciated, however, that groove 61A may have a rectangular cross section throughout or a variety of other configurations which allow groove 61A to mate with the wall of a spa.

Wet leg 49 is configured to be disposed within liquid within spa bath 12 while dry leg 51 is configured to be disposed outside of spa bath 12. Wet leg 49 includes a plurality of inlet and outlet ports which extend therethrough. Port fittings of the respective inlet and outlet plumbing 45, 47 couple to cover 46 within these ports of wet leg 49.

On side member 82 thereof, wet leg 49 of cover 46 includes an inlet port through which a port fitting 59 of inlet plumbing system 45 is disposed, port fitting 59 defining a port 63 for liquid to flow into inlet plumbing 45. Filter housing 54 of inlet plumbing 45 couples to port fitting 59. Fluid flows from spa bath 12 through port fitting 59 and filter housing 54 into pump 44. Perforated cover 58 is disposed on filter housing 54 to prevent large objects from entering inlet plumbing 45.

On the corner of wet leg 49 between face 81 and side member 82, wet leg 49 includes an outlet port which receives a corner outlet port fitting 60 of outlet plumbing 47. Fitting 60 defines a port 65 for enabling fluid from pump 44 to flow into spa bath 12. Corner outlet port fitting 60 is positioned so as to cause liquid to flow in a circular, whirlpool motion about spa bath 12.

Front outlet port fittings 61, 62 of outlet plumbing 47 disposed in outlet ports in face 81 of wet leg 49 are also designed to allow liquid from pump 44 to flow into spa bath 12. Port fittings 61, 62 are positioned so as to focus water massaging action on the neck and 1 back of the user rather than creating a whirlpool action as performed by port 65 defined by corner outlet port fitting 60.

Thus, the outlet ports 65, 67, 69 defined by respective port fittings 60, 61, 62 can be used to create a bubbling, whirlpooling action which massages the user while the user enjoys basking in the warm circulating liquid within spa bath 12. Assembly 14 thus provides for a plurality of outlet ports having a variety of different functions and orientations to massage different parts of the body of the user.

Cushion 64 is disposed on intermediate portion 52 of cover 46 to provide for the user a convenient place to rest the user's neck and shoulders while enjoying the massaging and whirlpooling action from assembly 14. A user is thus able to rest a portion of the user's body on the cushion while placing another portion of the user's body adjacent one or more outlet ports 67, 69 located substantially below cushion 64 on cover 46.

A decal 66 may be placed on intermediate portion 52 of assembly 14 thereby allowing a manufacturer to advertise and provide warnings and other information relating to the manufacturer's product and also permitting the placement of indicia 68 such as words and markings adjacent controls 70 to thereby instruct the user on the use of controls 70.

FIG. 5 demonstrates certain control knobs 70 associated with assembly 14. As shown, control knobs 70 located on intermediate portion 52 of assembly 14 allow for a variety of different options and activities. Control knobs 70 are strategically positioned in this location in order to avoid being immersed in the liquid within container while still permitting the convenient control of assembly 14 by the user while the user is enjoying system 10.

Primer cap 80 is removably coupled to intermediate portion 52 of assembly 14 and permits convenient access into inlet plumbing 45, thereby allowing the user to prime pump 44 before using pump 44.

Assembly 14 further includes means for selectively directing the flow of liquid in a desired direction, such as a diverter having a control knob 78 located on intermediate portion 52 of cover 46. Diverter knob 78 allows the user to selectively divert liquid to corner port 65, front ports 67, 69, or both corner port 65 and front ports 67, 69. In another embodiment, assembly 14 is manufactured without a diverter, allowing liquid to flow constantly to front ports 67, 69 and corner port 65 while assembly 14 is in use.

Assembly 14 further comprises means for selectively enabling air to enter spa bath 12 along with the liquid discharged through outlet plumbing 47. As one component of the means for selectively enabling air to enter, air control knob 72 allows the user to control the amount of the air desired to flow through ports 65, 67, 69. An on/off button 74 allows the user to selectively turn assembly 14 on and off.

Figure 6:
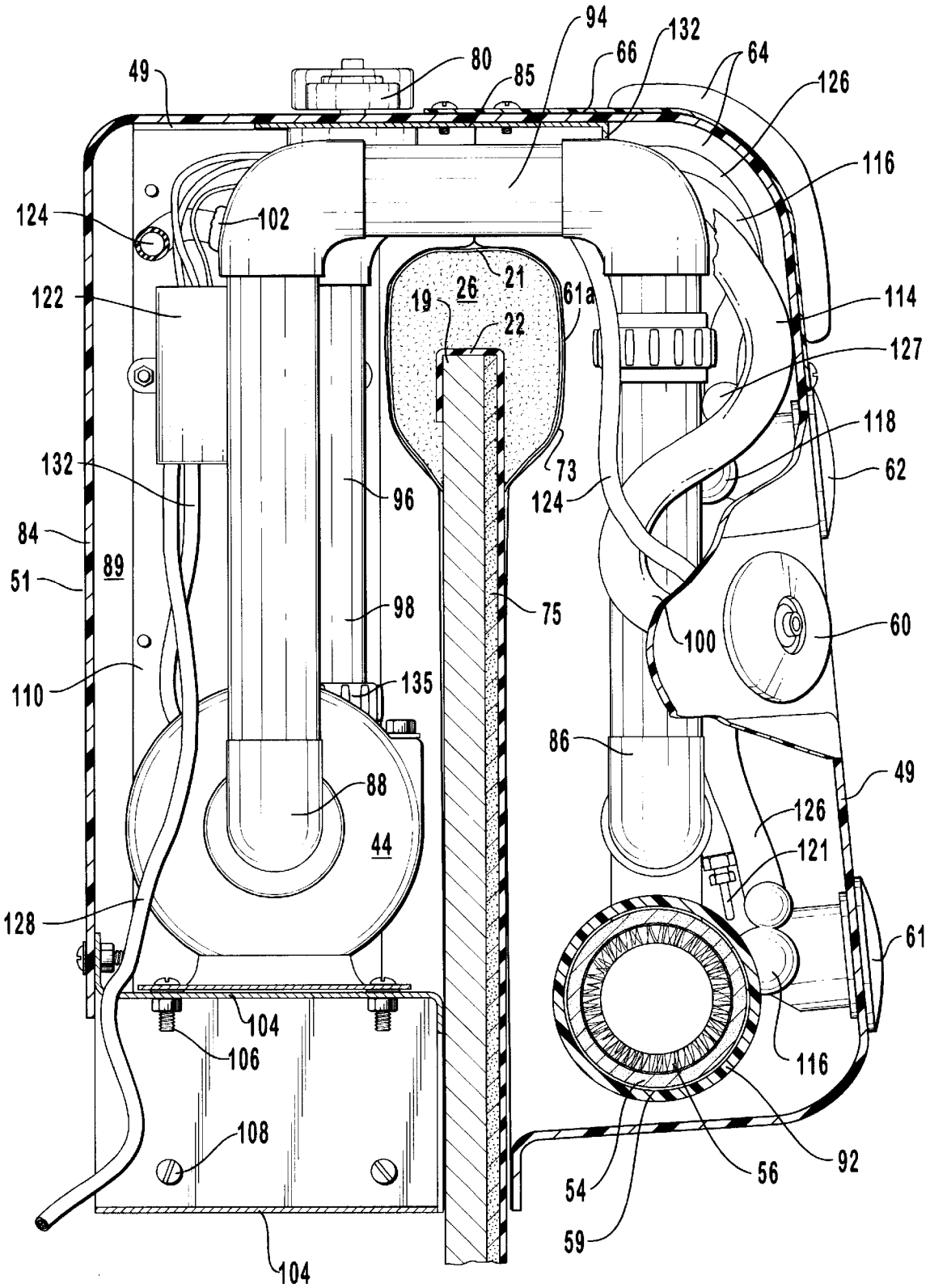
FIG. 6 demonstrates a side view of the assembly shown in FIG. 4 taken along lines 6—6 of FIG, 4.

Reference will now be made to FIG. 6. In order to view the components at least partially surrounded by U-shaped cover 46, FIG. 6 is a view of assembly 14 taken at 6-6. Groove 61A is disposed on wall 34. In order to form rim 21 of wall 34, clamp 26 is disposed on opposing sides of rim 22 of elastomeric liner 20 thereby retaining liner 20 on opposing sides of container body 18. Intermediate portion 52 of cover 46 is configured to be disposed on rim 21 of spa bath 12 between wet leg 49 and dry leg 51.

As further shown in FIG. 6, an example of means for coupling first shell 48 to second shell 50 comprises coupling plate 85. Shells 48, 50 are coupled to plate 85 through the use of screws, or bolts for example. As shown, decal 66 is also coupled to the upper portions of shells 49, 51 with the same screws or bolts used to couple shells 49, 51 to plate 85.

In the embodiment of FIG. 6, shells 48, 50 flex outwardly when the user disposes assembly 46 on wall 34, then grip wall 34 without forming a liquid tight seal between wet leg 49 and wall 34. Because in one embodiment wet leg 49 is not designed to seal against wall 34, one or more spaces exist between wet leg 49 and wall 34 to allow liquid to flow between wet leg 49 and wall. In another embodiment, however, wet leg 49 is sealed against the entry of water therein, such as by having a rear face coupled to side members 82, 83 which prevents water from leaking into wet leg 49, or by being configured to be sealed against wall 34, for example.

Cover 46 is removably coupled to spa bath 12 by being configured to have groove 61 of cover 46 having upper bulbous portion 73 disposed about the bulbous shaped outer portion of clamp 26 of wall 34 and a rectangular portion 75 disposed against the remainder of wall 34. The configuration of cover 46 protects pump 44 and plumbing 45, 47 from damage and makes pump 44 and plumbing 45, 47 conveniently transportable. It will be appreciated however that although cover 46 has been described in detail, cover 46 may be configured in a variety of different manners. For example, it will be appreciated that cover 46 and a rim of a spa bath may have a variety of different configurations which will allow device 14 to be removably coupled to a spa bath, such as through the use of gravity alone.

Pump 44 is coupled to mounting bracket 104 of shell 50 through the use of bolts 106. Bracket 104 is coupled through the use of bolts 108 to side cover plate 110 of shell 50 which is coupled to shell member 89 of shell 50. Because of the configuration of pump 44 and inlet and outlet plumbing 45, 47, pump 44 provides liquid to a variety of different ports at different locations.

In order to heat liquid with spa bath 12, assembly 14 comprises means for heating liquid within spa bath 12. In one embodiment, the means for heating the liquid comprises a heat recovery system. According to the configuration of the heat recovery system disclosed in FIG. 6, heat is transferred from pump 44 to liquid flowing through pump 44. In addition, while pumping liquid through the over-the-rim inlet and outlet plumbing 45, 47, friction heats the liquid. Heat provided by the heat recovery system is thus a combination of frictionally generated heat and heat transferred from pump 44. Pump 44 thus serves as a source of fluid flow and also as an example of means for heating liquid. In another embodiment, as discussed below, a heating element also heats the liquid within spa bath 12.

Assembly 14 further comprises means electrically coupled to the means for heating liquid within the spa bath for sensing the temperature of the liquid within spa bath 12 and for activating the means for heating the liquid when the temperature of the liquid drops below a desired, selected temperature. As shown in FIG. 6, in one embodiment, the means electrically coupled to the means for heating liquid for sensing the temperature of the liquid and for activating the means for heating liquid when the temperature of the liquid drops below a desired, selected temperature comprises (i) a temperature sensor 121; (ii) a thermostat electrically coupled to sensor 121 and to pump 44; and (iii) a thermostat control knob 76. The thermostat and related circuitry are disposed in an electronics console 122 mounted to side housing plate 1 10 of second shell 50 of cover 49. Thermostat control knob 76 is electrically coupled to the thermostat within electronics console 122 and allows a user to select a desired temperature for the liquid within the spa. In another embodiment, as discussed below, the thermostat is electrically coupled to sensor 121, knob 76 and a heating element.

Pump 44 includes means for providing electrical power to pump 44, including an electrical cord electrically coupled to an electrical outlet, a battery, or a generator, or console 122, as shown. Pump 44 also includes a drain plug for draining pump 44 in the event of prolonged storage or exposure to freezing temperatures.

While it will be appreciated that a variety of different pumps may be employed in the present invention, in one embodiment pump 44 employed in the present invention comprises an Ultra-Jet pump manufactured by VICO Products Manufacturing Company, Incorporated, So. El Monte, Calif. 91733, swimming pool or spa pump, model no. PUULS10138GR, one horsepower, Ultima SD/CS 115V, 9.9A, 60 cy., 1-spd. However, since cover 46 is readily opened, a variety of different pumps may be employed, such as AC pumps, DC pumps, single, double, or variable speed pumps.

With continued reference to FIG. 6, inlet plumbing 45 will now be described in additional detail. Inlet plumbing 45 comprises a first inlet conduit 86 having (i) a pump end 88 coupled to the inlet end of pump 44, (ii) an inlet end 92 disposed within the liquid in spa bath 12, the inlet end including port fitting 59 and (iii) an intermediate portion 94 coupling inlet end 92 to pump end 88 of conduit 86. Conduit 86 includes filter housing 54 which houses a filter 56 removably coupled within filter housing 54. Filter 56 is thus removably coupled to first inlet conduit 86.

Outlet plumbing 47 comprises a first outlet conduit 96 having (i) a pump end 98 coupled to the outlet end 135 of pump 44, (ii) a outlet end 100 including outlet port fitting 60, and (iii) an intermediate portion 102 coupling pump end 98 to outlet end 100. A cutaway portion of intermediate portion 102 is shown in FIG. 6.

Outlet plumbing 47 further comprises a second outlet conduit 116. Second conduit 116 extends from first conduit 96 and terminates in and includes at least one port fitting 61. The diverter mechanism coupled to diverter knob 78 is disposed within the joint 112 coupling first conduit 96 to second conduit 116. The diverter selectively directs liquid flowing from pump 44 between (i) a downstream portion 114 of first conduit 96 and/or (ii) second conduit 116. A third outlet conduit 118 extends from second outlet conduit 116 and terminates in and includes at least one port fitting 62. The diverter allows liquid to flow through port 65, and/or ports 67, 69.

As mentioned above, wet leg 49 does not seal in a water tight fashion against spa bath 12, but instead allows water to flow between wet leg 49 and spa bath 12. Wet leg 49 and wall 34 thus define an internal cove in which sensor 121 is maintained immersed in liquid. Wet leg 49 thus allows water to flow into the cavity while nevertheless protecting sensor 121 from the activities occurring within spa bath 12.

Electronics console 122 has a power cord 128 for coupling to a power source such as a wall mounted outlet and to power cord 132 extending to pump 44. Although a variety of different electronic consoles may be employed in the present invention, in one embodiment electronics console 122 is the mini-pack 1-120, option RD1, Gecko Electronic Incorporated, Made in Canada, 120 VAC, 12A to pump, input 120 VAC, 50/60 Hz, 15A, Ozone 120 VAC 3A.

When the temperature of the liquid in spa bath 12 drops below the desired temperature as sensed by temperature sensor 121, electronics console 122 causes pump 44 to pump water, thereby heating the water to the desired temperature. In one embodiment, console 122 features an automatic filter cycle and freeze protection setting. At one setting if pump 44 has not been operated for three hours, pump 44 will begin circulating liquid for 20 minutes to filter any impurities. Also, if the water temperature falls below 40° F., pump 44 will begin circulating and heating the liquid to prevent the liquid from freezing.

As mentioned above, assembly 14 comprises means for selectively enabling air to enter spa bath 12 along with the liquid discharged through outlet plumbing 47. In the embodiment shown in FIG. 6, the means for selectively enabling air to enter comprises an air inlet system and an air outlet system. The air outlet system comprises a first air outlet conduit 124 which terminates in corner port fitting 60 and second and third air outlet conduits 126, 127 which terminate in respective front port fittings 61, 62. Venturi valves in fittings 60, 61, 62 draw air through the air outlet conduits.

In the embodiment shown in FIG. 6, cushion 64 is disposed within a recess formed in shell 48 and abuts a lip 132 of upper housing plate 85. It will be appreciated, however, that cushion 64 may be configured in a variety of different configurations such as by having cushion 64 be disposed against a front shell having no such recess formed therein. In one embodiment, for example, plate 85 does not contain lip 132 because no recess is formed in shell 48.

Figure 7:
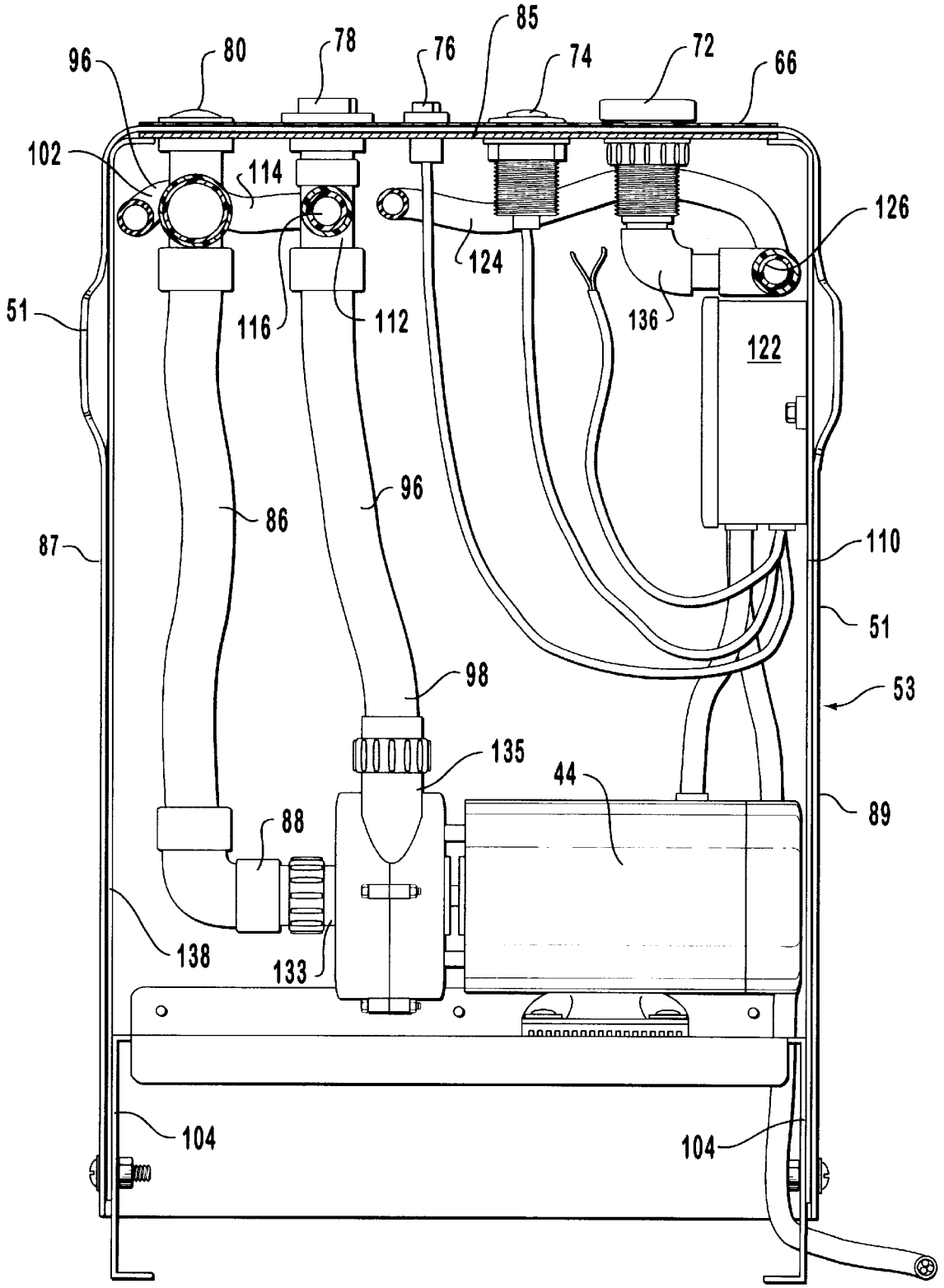
FIG. 7 demonstrates a view inside the rear shell of the assembly shown in FIG. 4 taken along lines 7—7 of FIG. 4.

With reference now to FIG. 7, inlet end 133 and outlet end 135 of pump 44 are shown. First inlet conduit 86 has an opening at an upper portion thereof covered by primer cap 80 which the user removes to pour liquid such as water into conduit 86 to prime pump 44 before use.

Outlet system 47 includes a junction 112 at which second conduit 116 begins. Junction 112 includes the diverter mechanism coupled to diverter knob 78 for selectively directing liquid flowing from pump 44 between a downstream portion 114 of first conduit 96 and/or second conduit 116.

Air inlet control knob 72 opens air inlet conduit 136 which couples to first air outlet conduit 124 terminating in port fitting 60 and second air outlet conduit 126 terminating in port fittings 61. Third air outlet conduit 127 extends from conduit 126. Air is sucked into air inlet conduit 136 and through air outlet conduits 124, 126, 127 and through respective port fittings 60, 61, 62. A second side cover plate 138 of shell 50 is also shown in FIG. 7.

Figure 8:
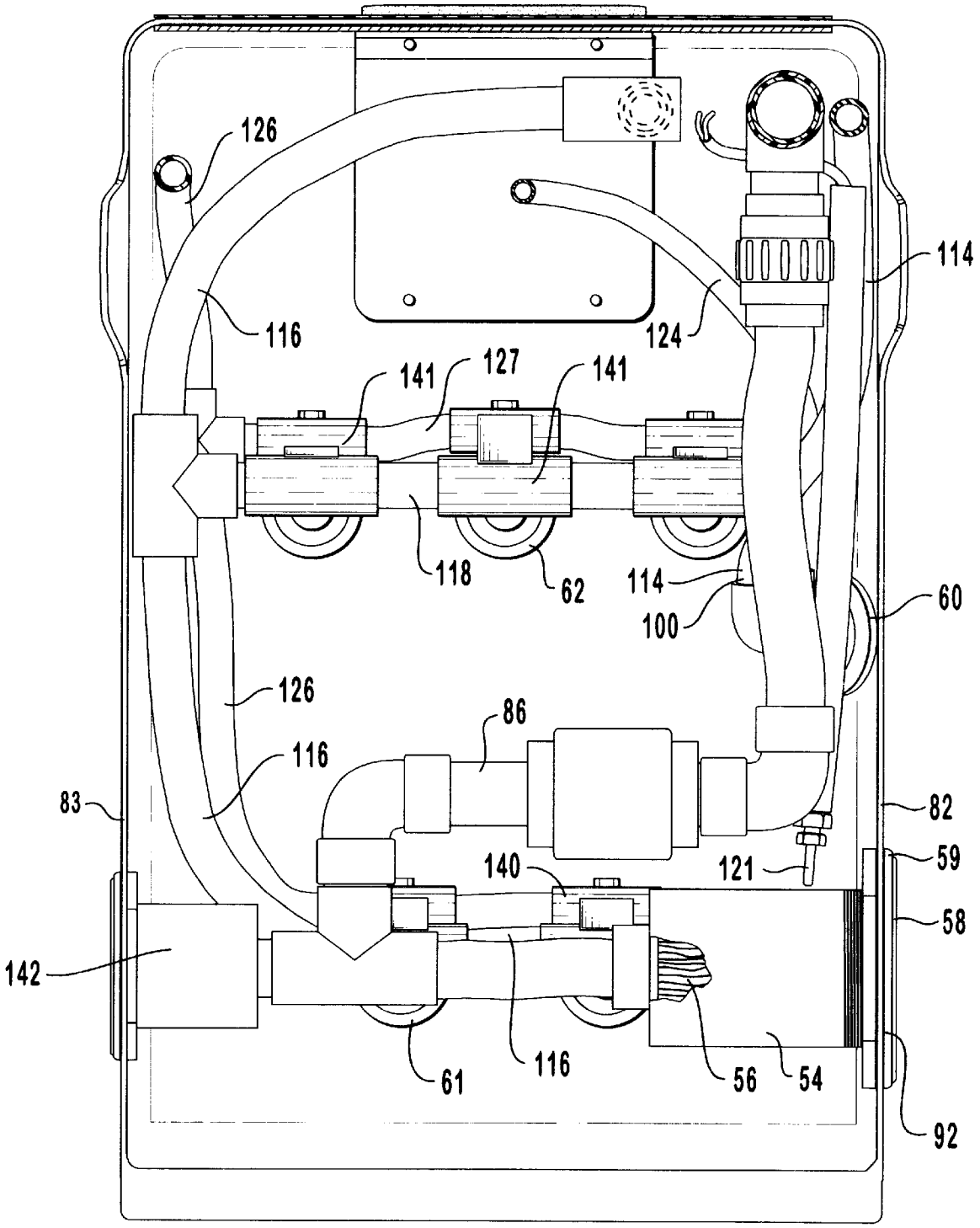
FIG. 8 demonstrates a view inside the front shell of the assembly shown of FIG. 4 taken along lines 8—8 of FIG. 4.

FIG. 8 demonstrates the junctions 140, 141 between respective front port fittings 61, 62 coupled to cover 46 and outlet conduits 116, 118. Filter housing 54 at inlet end 92 of first inlet conduit 86 is coupled to fitting 59 of first inlet conduit 86. Filter 56 is removably coupled to filter housing 54. Filter 56 can be removed for cleaning and replacement. Also as shown in FIG. 8, a second inlet conduit 142 is coupled to first inlet conduit 86 and to cover 46 by being disposed through an inlet port in cover 46. Conduit 142 allows non-filtered liquid to enter pump 44. In addition, third air outlet conduit 127 is shown extending from second air outlet conduit 126 and terminating in port fittings 62.

Figure 9:
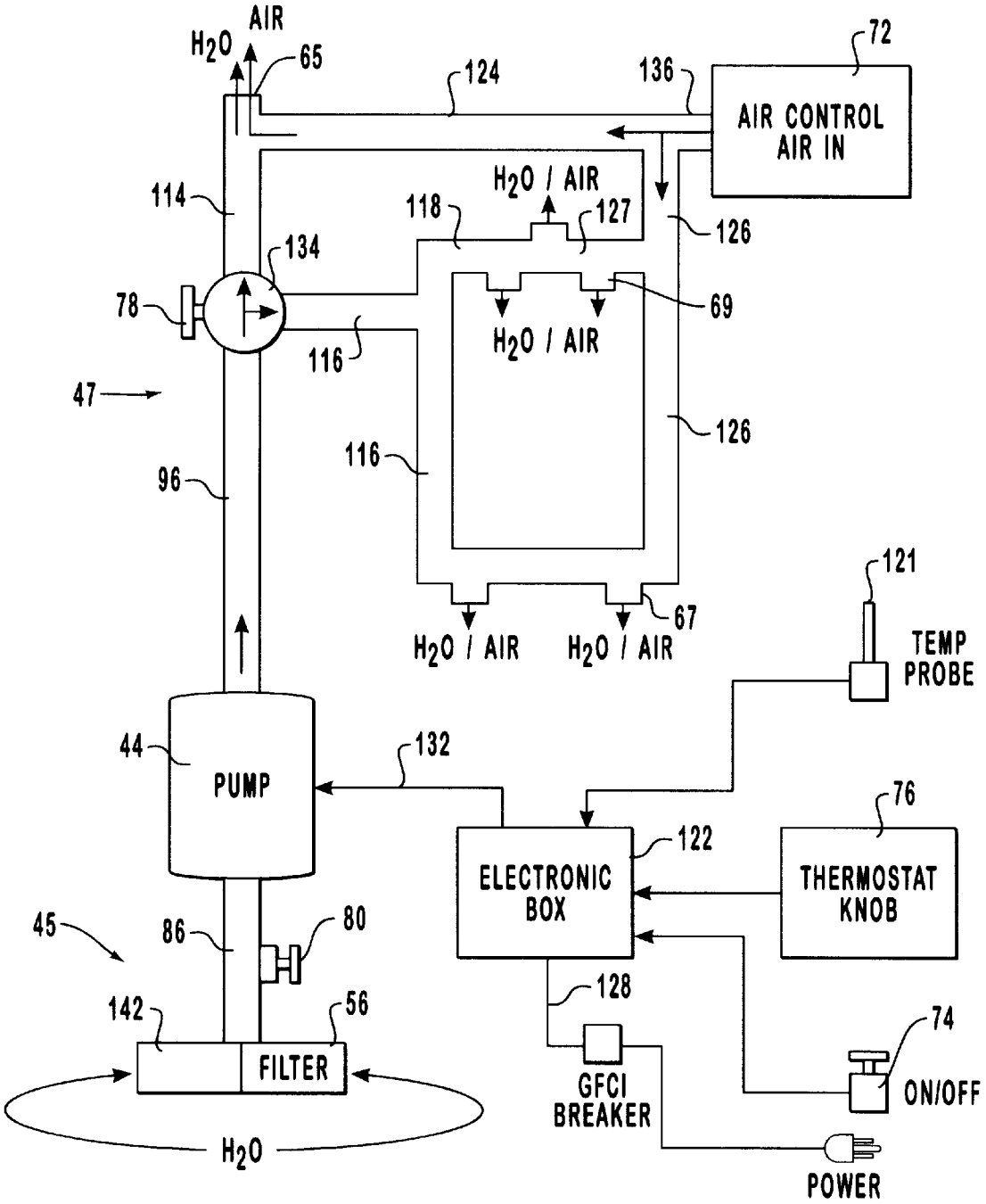
FIG. 9 demonstrates a schematic view of the operation of the assembly shown in FIG. 4.

With reference to FIG. 9, the operation of assembly 14 will now be described. Before operating pump 44, pump 44 should be primed by opening primer cap 80 and pouring water into inlet conduit 86. Pump 44 draws liquid from spa bath 12 through conduit filter 56 and through non-filtered second inlet conduit 142. Pump 44 then discharges water through first outlet conduit 96 which branches into second outlet conduit 116 and a downstream portion 114 of first conduit 96. Diverter control knob 78 controls the diverter mechanism 134 which allows liquid to flow into corner port 65 and/or front ports 67, 69.

Air control knob 72 selectively allows air to flow into air inlet conduit 136 which branches into air outlet conduits 124 and 126 which allow air to flow into corner port 65 and front ports 67, 69. Temperature sensor 121 senses the temperature of the liquid within spa bath 12 and communicates the measurement of the temperature to electronics console 122 which also receives the desired temperature measurement from temperature control knob 76. Upon the temperature dropping below the temperature set by temperature control knob 76, the thermostat in electronics console 122 causes pump 44 to run, thereby warming the liquid.

Figure 10:
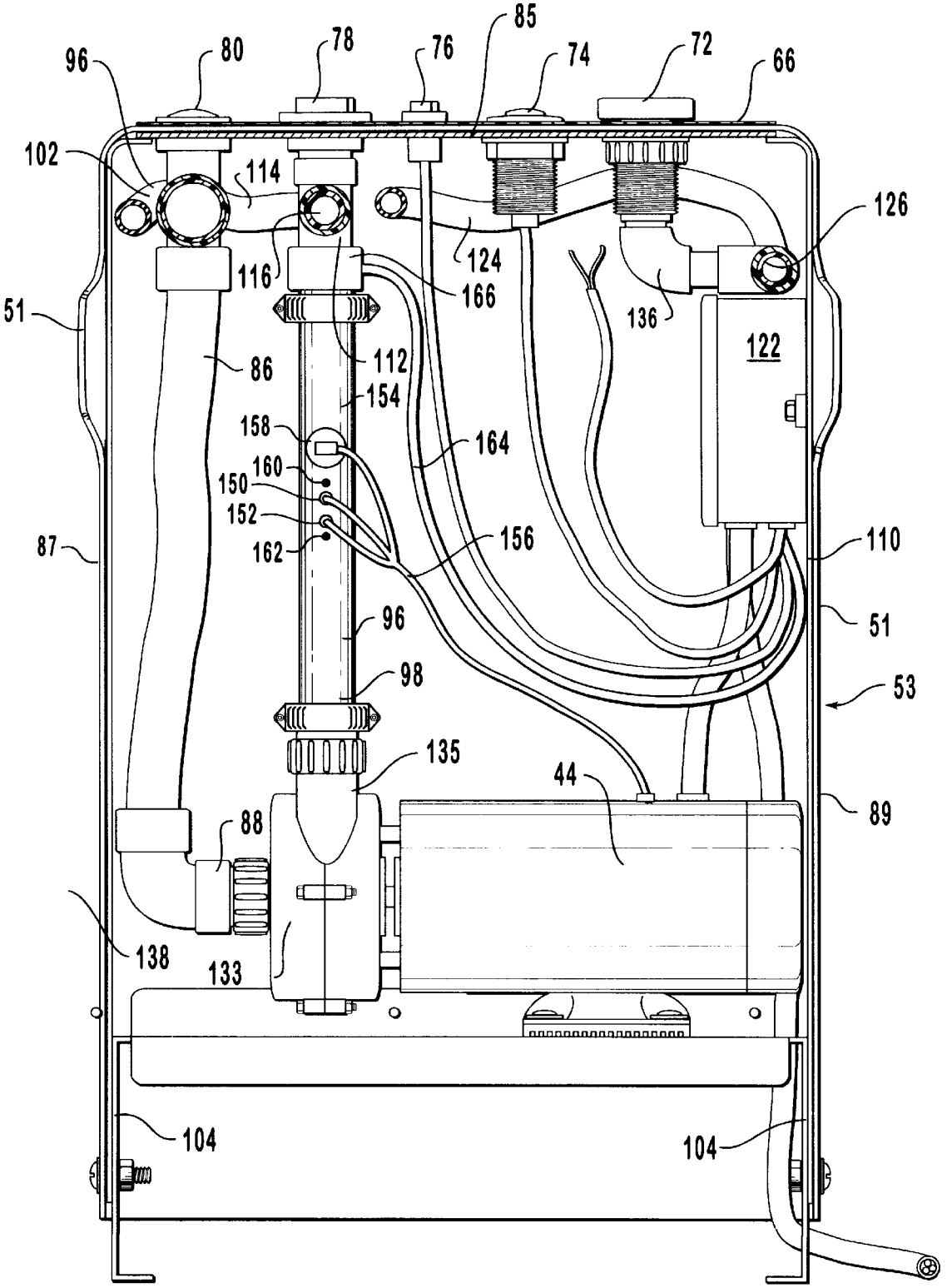
FIG. 10 demonstrates an alternate embodiment of a view inside the rear shell.

Another embodiment of spa pump assembly 14 is shown in FIG. 10. FIG. 10 is an alternative view inside rear shell 50 from the view shown in FIG. 7. In this embodiment of spa assembly 14, the means for heating liquid within the spa comprises pump 44 and a heating element. In the embodiment of FIG. 10, the heating element is disposed within a portion of conduit 96 located between outlet end 135 of pump and junction 112. The portion of conduit 96 in which the heating element is disposed comprises a stainless steel tube 154.

The heating element comprises first and second terminals 150, 152 extending from a U-shaped body (not shown) which is disposed within tube 154. Terminals 150 and 152 are welded to tube 154 and extend through apertures in tube 154. Posts 160, 162 are coupled to tube 154 to receive a cover (now shown) which covers terminals 150, 152. The heating element is electrically coupled to sensor 121 by being electrically coupled by electrical cord 156 to pump 44. In one embodiment, when a low speed of pump 44 is activated, the heating element is also activated, heating the liquid within tube 154.

Electrical cord 156 is also coupled to means for preventing overheating of assembly 14. In one embodiment, the means for preventing overheating of assembly 14 comprises a microswitch 158 mounted on tube 154 which is coupled to a pressure sensor (not shown) disposed within tube 154. In one embodiment, microswitch 158 is screwed through an aperture in tube 154 into the pressure sensor and comprises a 120 volt microswitch. Microswitch 158 terminates electrical power to the heating element when there is insufficient water pressure within tube 154 and therefore insufficient water pressure within assembly 14.

As another example of means for preventing overheating of assembly 14, assembly 14 further comprises a high limit temperature probe disposed within conduit 96 downstream from the heating element. Electrical cord 164 electrically couples the high limit temperature probe to console 122. The high limit temperature probe may be located within conduit 96 adjacent location 166, for example. The high limit temperature probe senses liquid at 122° or hotter and deactivates assembly 14 if the liquid is at the temperature of 122° or more. This prevents pump 44 and the heating element from being activated.

While it will be appreciated that a variety of different pumps may be employed in the embodiment shown in FIG. 10, in one embodiment pump 44 of FIG. 10 comprises an Ultra-Jet pump manufactured by VICO Products Manufacturing Company, Incorporated, So. El Monte, Calif. 91733, Model No. PUULS215138GRH, 1.5 horsepower, true rate, 60 cy., 2-spd, Ultima, SD-CS, 115V, 11.9A/3.3A. This pump has a low speed and a high speed. In one embodiment the console 122 shown in FIG. 10 is manufactured by Chang Chen Instruments, Taipei, Taiwan, Model No. EJ-06.

In the embodiment shown in FIG. 10, the low speed side of pump 44, pressure switch 158 and the heating element are all wired in a series loop. Console 122 may be programmed such that as temperature sensor 121 within wet leg 48 senses a temperature of liquid lower than the desired temperature selected by the user with temperature control knob 76, control console 122 activates pump 44 to the low speed, thereby activating the heating element and heating the liquid to the desired temperature. In another embodiment, the heating element is electrically coupled to the high speed portion of pump 44 and activated during high speed operation. Microswitch 158 prevents activation of the heating element if water pressure in tube 154 is too low.

In addition, assembly 14 can be programmed such that upon pressing on/off button 74 one or more times pump 44 changes speeds or is deactivated. In one embodiment, if the user presses on/off button 74 during operation of pump 44, pump 44 is deactivated unless the temperature is below the desired temperature, in which case the low speed is activated in order to heat the liquid until reaching the desired temperature.

In another embodiment, the heating element is directly electrically coupled to console 122, rather than being electrically coupled to console 122 through pump 44. While a variety of different examples of means for heating liquid have been disclosed, it will be appreciated that these are only examples and a variety of different heating means and electrical couplings therefor may be employed consistent with the objects of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A spa pump assembly for use with a spa bath having a perimeter wall, the pump assembly comprising:

(a) a first substantially concave shell having an inlet port and an outlet port extending therethrough;

(b) a pump;

(c) an inlet conduit extending from the inlet port to the pump;

(d) an outlet conduit extending from the outlet port to the pump; and (e) a second substantially concave shell coupled to the first shell, the pump being mounted within the second shell, such that the assembly is selectively, removably secured on the wall of the spa bath with the wall between the shells.

2. A spa pump assembly as recited in claim 1, wherein the first shell and the second shell are configured to be mounted on opposing sides of the perimeter wall when the assembly is mounted on the wall.

3. A spa pump assembly as recited in claim 2, wherein the first and second shells flex outwardly with respect to each other.

4. A spa pump assembly as recited in claim 3, wherein the first and second outwardly flexing shells are each coupled to opposing ends of a plate.

5. A spa pump assembly as recited in claim 1, wherein the first shell and the wall of the spa bath form an internal cove for liquid to be disposed between the first shell and the wall, and wherein the spa pump assembly further comprises a temperature sensor electrically coupled to the pump and disposed within the liquid in the internal cove between the wall and the first shell, the first shell defining a cavity, the temperature sensor being located within the cavity of the first shell.

6. A spa pump assembly as recited in claim 1, wherein the inlet conduit includes a port fitting coupled to the inlet port of the first shell and the outlet conduit includes a port fitting coupled to the outlet port of the first shell.

7. A spa pump assembly as recited in claim 1, further comprising means for heating liquid within the spa bath.

8. A spa pump assembly as recited in claim 7, wherein the means for heating comprises a heating element.

9. A spa, comprising:

(a) a bath having an upstanding wall; and (b) a pump assembly removably mounted to the wall of the bath, the pump assembly comprising:

(i) a U-shaped cover having a dry, substantially concave shell coupled to a wet, substantially concave shell, and a mounting groove formed therebetween, the groove being configured to receive the wall of the bath such that the wet shell is received within the bath, the wet shell of the cover having an inlet port and an outlet port extending therethrough;

(ii) a pump disposed within the dry shell of the cover;

(iii) an inlet conduit extending from the inlet port to the pump; and (iv) an outlet conduit extending from the outlet port to the pump.

10. A spa as recited in claim 9, wherein each shell has a concave configuration, the wet shell having an opening adjacent the upstanding wall of the bath such that liquid within the bath freely moves through the opening into a cavity of the wet shell.

11. A spa as recited in claim 10, further comprising a temperature sensor disposed within the cavity of the wet shell remotely from the pump located in the dry shell.

12. A spa as recited in claim 11, further comprising a heating element disposed within the dry shell remotely from the temperature sensor within the wet shell.

13. A spa as recited in claim 9, wherein liquid within the spa bath moves freely between the wet shell and the wall of the bath, and further comprising a temperature sensor electrically coupled to means for heating the liquid, the temperature sensor disposed within the liquid within the wet shell.

14. A spa as recited in claim 13, wherein the means for heating the liquid comprises the pump being configured to heat the liquid.

15. A spa as recited in claim 13, wherein a space exists between the wet leg and the wall, allowing liquid to flow from the bath into the wet leg.

16. A spa as recited in claim 9, further comprising means electrically coupled to means for heating liquid within the spa bath for sensing the temperature of liquid within the spa bath and for activating the means for heating liquid within the spa bath when the temperature of the liquid drops below a desired, selected temperature.

17. A spa pump assembly as recited in claim 9, wherein the inlet conduit includes a port fitting coupled to the inlet port of the wet leg and the outlet conduit includes a port fitting coupled to the outlet port of the wet leg.

18. A self-contained, portable, spa pump assembly configured to be removably mounted to a liquid-filled container, the spa pump assembly comprising:

(i) a pump having an inlet end and a outlet end;

(ii) inlet plumbing having a pump end coupled to the inlet end of the pump, an inlet end configured to be disposed within the container, and an intermediate portion coupling the pump end to the inlet end;

(iii) outlet plumbing having a pump end coupled to the outlet end of the pump, an outlet end configured to be disposed within the container, and an intermediate portion coupling the pump end to the outlet end; and (iv) a first shell defining a cavity therein, the first shell coupled of the inlet plumbing and the outlet end of the outlet plumbing; and (v) a second shell defining a cavity therein and coupled to the first shell and configured to receive the pump end of the inlet plumbing, the pump end of the outlet plumbing, and the pump within the cavity of the second shell, wherein the first shell and the second shell selectively flex outwardly to receive a peripheral wall of the container therebetween.

19. A spa pump assembly as recited in claim 18, wherein the first and second shells each define a cavity and an opening, each opening configured to be placed adjacent a wall of the container.

20. A spa pump assembly as recited in claim 18, wherein each shell has a face and first and second side members extending toward a wall of the container from opposing sides of the face.

21. A spa pump assembly as recited in claim 20, wherein the first shell of the cover includes a first outlet port extending therethrough, the outlet plumbing extending between the first outlet port and the pump.

22. A spa pump assembly as recited in claim 21 wherein a cushion is located substantially above the first outlet port on the cover, enabling the user to rest a portion of the user's body on the cushion while orienting another portion of the user's body adjacent the first outlet port.

23. A spa pump assembly as recited in claim 21, further comprising a second outlet port extending through the wet leg, the outlet plumbing extending between the first and second outlet ports and the pump.

24. A spa pump assembly as recited in claim 23, wherein the second outlet port is located above the first outlet port.

25. A spa pump assembly as recited in claim 23, wherein the second outlet port is located away from the first outlet port such that liquid is discharged from the first and second outlet ports to different portions of a user's body.

26. A spa pump assembly as recited in claim 21, wherein the first shell includes a front face and first and second side members configured to extend between the container and the front face, and wherein the first outlet port is located in the front face of the first shell.

27. A spa pump assembly as recited in claim 26, further comprising a second outlet port extending through the first shell, the outlet plumbing extending between the first and second outlet ports and the pump, the second outlet port located in a corner between the front face of the first shell and the first side member of the first shell, the second outlet port configured to cause liquid within the container to flow in a circular motion.

28. A spa pump assembly as recited in claim 26, further comprising an inlet port extending through the first shell the inlet plumbing extending between the inlet port and the pump, the inlet port located in one of the first and second side members.

29. A spa pump assembly for use with a spa bath having a perimeter wall, the pump assembly comprising:

(a) a first, substantially concave shell configured to be placed within the spa bath, the first shell having an inlet port and an outlet port extending therethrough and defining a cavity therein;

(b) means for heating liquid within the spa bath, the means for heating the liquid comprising a pump;

(c) an inlet conduit extending from the inlet port to the pump;

(d) an outlet conduit extending from the outlet port to the pump;

(e) means attached to the first shell for removably securing the pump and the first shell to the wall of the spa bath such that liquid from the bath flows between the first shell and the wall into the cavity; and (f) a temperature sensor electrically coupled to the means for heating the liquid for sensing the temperature of the liquid within the spa bath, the temperature sensor located within the cavity of the first shell outside of the inlet and outlet ports and conduits to thereby directly contact the liquid within the spa bath.

30. A spa pump assembly as recited in claim 29, wherein the first shell is a flexible shell.

31. A spa pump assembly as recited in claim 29, wherein the first shell is coupled to a plate.

32. A spa pump assembly as recited in claim 29, further comprising means for preventing overheating of the spa pump assembly.

33. A spa pump assembly configured to be selectively, removably mounted on a spa bath, the pump assembly comprising:

(a) a pump;

(b) an inlet conduit extending from the pump to the spa bath, an inlet end of the inlet conduit configured to be disposed within the spa bath;

(c) an outlet conduit extending from the pump to the spa bath, an outlet end of the outlet conduit configured to be disposed within the spa bath;

(d) means for heating liquid within the spa bath;

(e) a temperature sensor electrically coupled to the means for heating the liquid, the temperature sensor configured to be disposed within the spa bath;

(f) first and second shells, each shell defining a cavity and an opening, the opening of each shell configured to be placed adjacent a wall of the spa bath when the assembly is selectively, removably mounted on the spa bath, the temperature sensor being disposed within the cavity of the first shell, such that the temperature sensor is located within liquid in the bath when the pump assembly is mounted on the bath, the pump being coupled to the second shell within the cavity of the second shell, such that the pump is located outside the bath when the pump assembly is mounted on the bath; and (g) a plate having opposing ends, the first and second shells coupled to opposing ends of the plate such that the first and second shells flex outwardly, then grip the wall of the spa bath when the assembly is mounted on the spa bath.

34. A spa pump assembly as recited in claim 33, wherein the means for heating liquid within the spa bath comprises a heating element.

35. A spa pump assembly as recited in claim 33, wherein the means for heating liquid comprises the pump being configured to heat the liquid.

36. A spa pump assembly as recited in claims, further comprising means for preventing overheating of the spa pump assembly.

* * * * *

UNITED STATES PATENT AND TRADEMARK OFFICE

CERTIFICATE OF CORRECTION

PATENT NO. : 6,003,166
DATED : December 21, 1999
INVENTOR(S) : Hald et al.

It is certified that error appears in the above-identified patent and that said Letters Patent is hereby corrected as shown below:

Title page,
U.S. PATENT DOCUMENTS, please insert the following references:

| | |
|---|---|
| 5,178,523 | Cheng-Chung |
| 5,038,853 | Callaway, Sr. et al. |
| 4,872,224 | Grimes et al. |
| 5,682,625 | Leaverton et al. |
| 5,199,116 | Fischer |
| 3,674,020 | Jacuzzi |

Column 4,
Line 66, after "container" change "14" to -- 18 --

Column 6,
Line 20, after "outlet plumbing" change "45" to -- 47 --
Lines 20 and 21, after "inlet plumbing" change "47" to -- 45 --

Column 7,
Line 20, after "and" delete "1"

Column 9,
Line 15, after "plate" change "1 10" to 110 --
Line 52, after "(ii)" change "a" to -- an --

Column 11,
Line 49, after "cover" change "(now shown)" to -- (not shown) --

UNITED STATES PATENT AND TRADEMARK OFFICE

CERTIFICATE OF CORRECTION

PATENT NO. : 6,003,166
DATED : December 21, 1999
INVENTOR(S) : Hald et al.

It is certified that error appears in the above-identified patent and that said Letters Patent is hereby corrected as shown below:

Column 13,
Line 36, indent all of section "(i)"

Column 14,
Line 16, after "and" change "a" to -- an --

Signed and Sealed this

Nineteenth Day of February, 2002

*Attest:*

*Attesting Officer*

JAMES E. ROGAN
*Director of the United States Patent and Trademark Office*